US005299395A

United States Patent [19]

Smith et al.

[11] Patent Number: 5,299,395

[45] Date of Patent: Apr. 5, 1994

[54] CANOPY STRUCTURE AND METHOD OF ASSEMBLY

[76] Inventors: Eugene P. Smith, N3791 N. U.S. 2; Lawrence P. Smith, N3610 Moon Lake Dr., both of Iron Mountain, Mich. 49801

[21] Appl. No.: 903,992

[22] Filed: Jun. 24, 1992

[51] Int. Cl.[5] ..... E04B 7/16

[52] U.S. Cl. ..... 52/74; 52/73; 52/76; 52/77

[58] Field of Search ..... 52/73 X, 74 OR, 76, 52/462, 77

[56] References Cited

U.S. PATENT DOCUMENTS

| | | | |
|---|---|---|---|
| 2,586,318 | 2/1952 | Fields | 52/77 |
| 3,103,715 | 9/1963 | Noecker | 52/74 |
| 3,234,697 | 2/1966 | Toti et al. . | |
| 4,179,857 | 12/1979 | Danford | 52/73 |
| 4,261,143 | 4/1981 | Rizzo | 52/73 |
| 4,692,847 | 9/1987 | Gandy . | |
| 4,785,591 | 11/1988 | Dahlen . | |
| 4,796,391 | 1/1989 | Lu . | |
| 4,796,393 | 1/1989 | Toti . | |
| 5,008,967 | 4/1991 | Barrios et al. . | |

FOREIGN PATENT DOCUMENTS

| | | | |
|---|---|---|---|
| 2335916 | 2/1974 | Fed. Rep. of Germany | 52/74 |
| 2452482 | 5/1975 | Fed. Rep. of Germany | 52/74 |
| 2491526 | 4/1982 | France | 52/74 |
| 287708 | 8/1931 | Italy | 52/74 |
| 768716 | 2/1957 | United Kingdom | 52/74 |

*Primary Examiner*—Carl D. Friedman
*Assistant Examiner*—Wynn Wood
*Attorney, Agent, or Firm*—Foley & Lardner

[57] ABSTRACT

A canopy for overhanging a door or window and the method of assembling the canopy to the wall. The assembly including a pair of channel assemblies mounted in a spaced relation between the structural girts of the wall over the door or window, a frame assembly having an angle member on each side for connecting the assembly to the channel assemblies, a roof-trim assembly mounted on the frame assembly and a soffit sheet mounted on the bottom of the roof-trim assembly to enclose the roof-trim assembly.

7 Claims, 6 Drawing Sheets

CANOPY STRUCTURE AND METHOD OF ASSEMBLY

FIELD OF THE INVENTION

The present invention relates to a canopy for overhanging a door or window in a building and a method for assembling and mounting the canopy in the wall above the door.

BACKGROUND OF THE INVENTION

A canopy or awning typically includes a frame having an upright back or rear portion which is used to secure the awning or canopy to a vertical wall. The awning or canopy is generally preassembled and then mounted on the wall by any convenient means.

Various forms of canopies or awnings are shown in U.S. Pat. No. 3,234,697 to Andrew J. Toti, et al., issued February 1966, and U.S. Pat. No. 4,796,393, to Andrew J. Toti, issued Jan. 10, 1989. Both of these patents contemplate a kit approach wherein various configured metal pieces are interconnected or snapped together to form the canopy or awning. This requires the structural components to be accurately formed in order to achieve a tight fit between the metal pieces. The assembled awning is supported on the face of the wall by a fastener mounted on the face of the building or structure.

SUMMARY OF THE PRESENT INVENTION

The present invention relates to a canopy and to the method of assembling the canopy on the wall of a building. The canopy basically includes a frame assembly, a roof trim assembly and a pair of channel assemblies which are assembled on the wall as follows. The channel assemblies are vertically mounted between the girts on the inside of the building wall. An opening is cut in the wall of the building in alignment with each of the vertical channel assemblies. The frame assembly includes an angle member on each side which are inserted through the openings in the wall into mating engagement with the corresponding channel assembly, and temporarily secured thereto. A line is drawn across the face of the wall above the frame assembly. The frame assembly is removed and a slot is cut in the building wall panels immediately above the line. The frame assembly is then secured to the vertical channel assemblies.

The roof trim assembly includes an eave on each side which is aligned with the angle members on the frame assembly. The roof trim assembly is pushed onto the frame assembly into abutting engagement with the wall panel. A step flash is positioned in the slot from the inside of the wall panel in alignment with the top of the roof-trim assembly and sealed to the roof-trim assembly. A wall support member is positioned on the inside of the wall and secured thereto to hold the step flash in place and to close the slot.

The present invention thus provides a method for quickly and easily assembling a canopy on a building which provides an aesthetically appealing structure.

Another aspect of the invention is the performance of the three basic assemblies which can be mounted on the building wall in a minimum of time and effort.

Other principal features and advantages of the invention will become apparent to those skilled in the art upon review of the following drawings, the detailed description and the appended claims.

Figure 1:
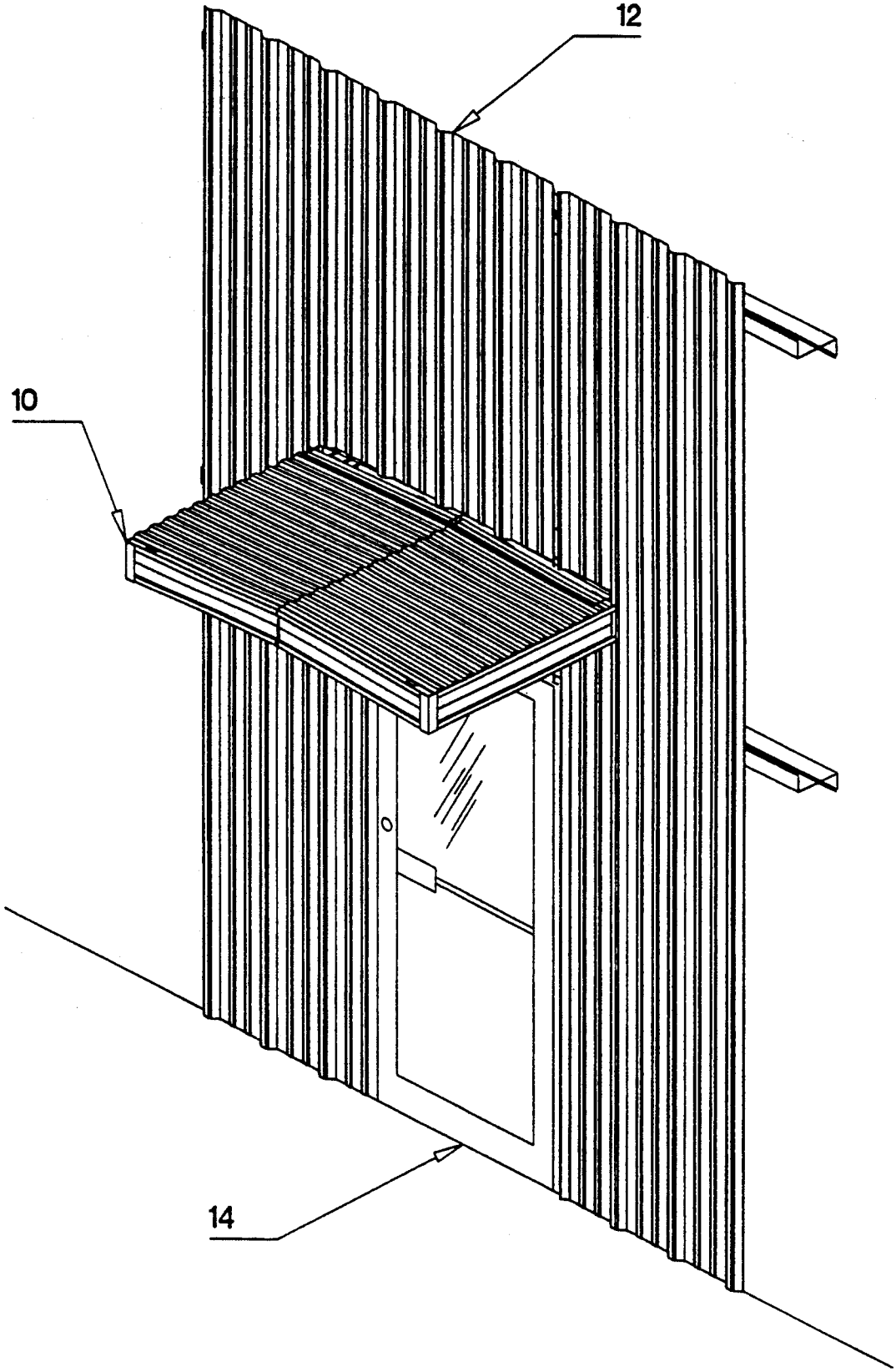
FIG. 1 is a perspective view showing the canopy mounted above a door in a wall.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
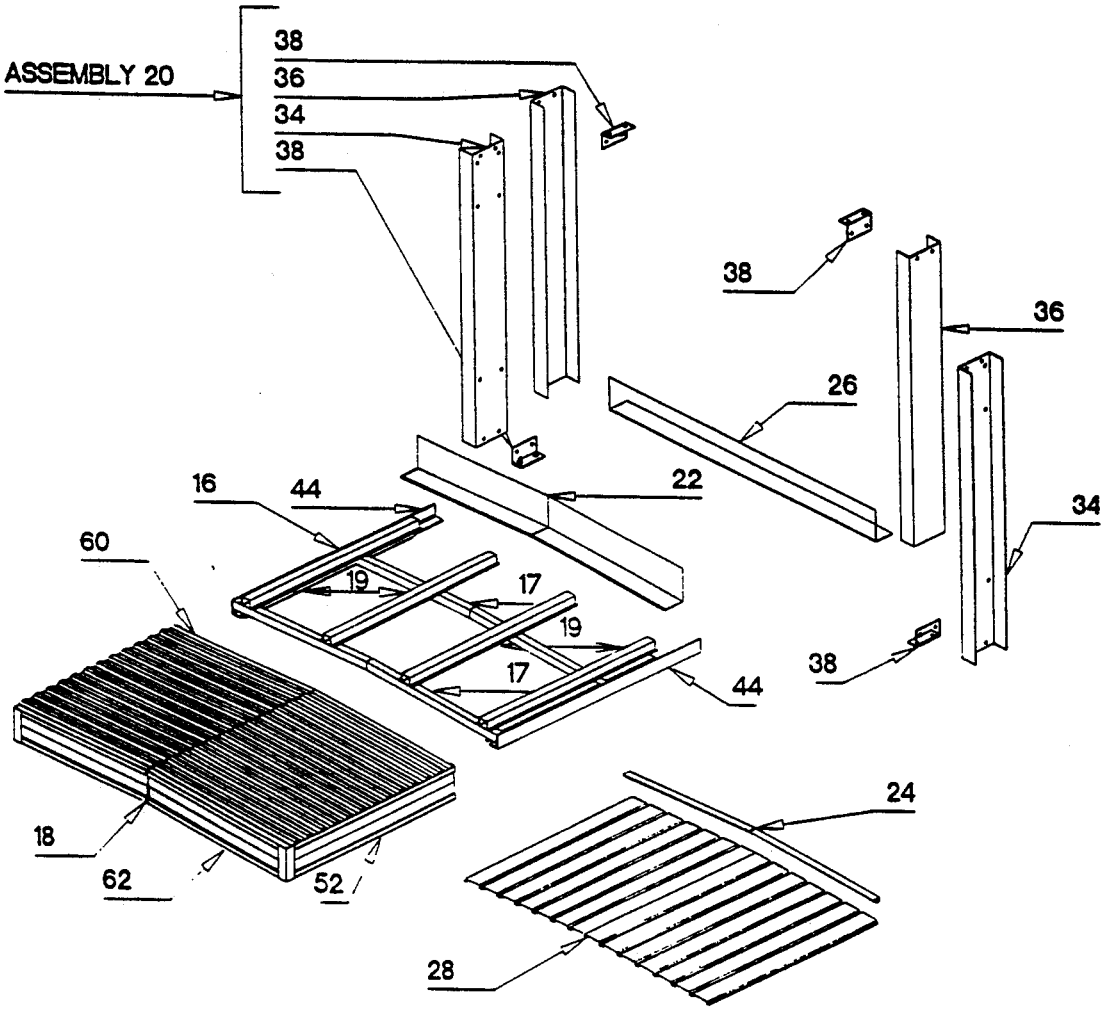
FIG. 2 is an exploded perspective view of the canopy assembly.

The canopy 10 according to the present invention as shown in FIG. 1 is mounted on the wall sheets 12 for a building above a doorway 14. It should be understood that the canopy 10 could also be mounted above a window. The canopy 10 as shown in FIG. 2 generally includes a frame assembly 16, a roof-trim assembly 18 and a pair of vertical support channel assemblies 20. A step flash 22, a wall sheet support member 26, a soffit sheet 28 and a soffit flash 24 are also provided to complete the canopy.

Figure 3:
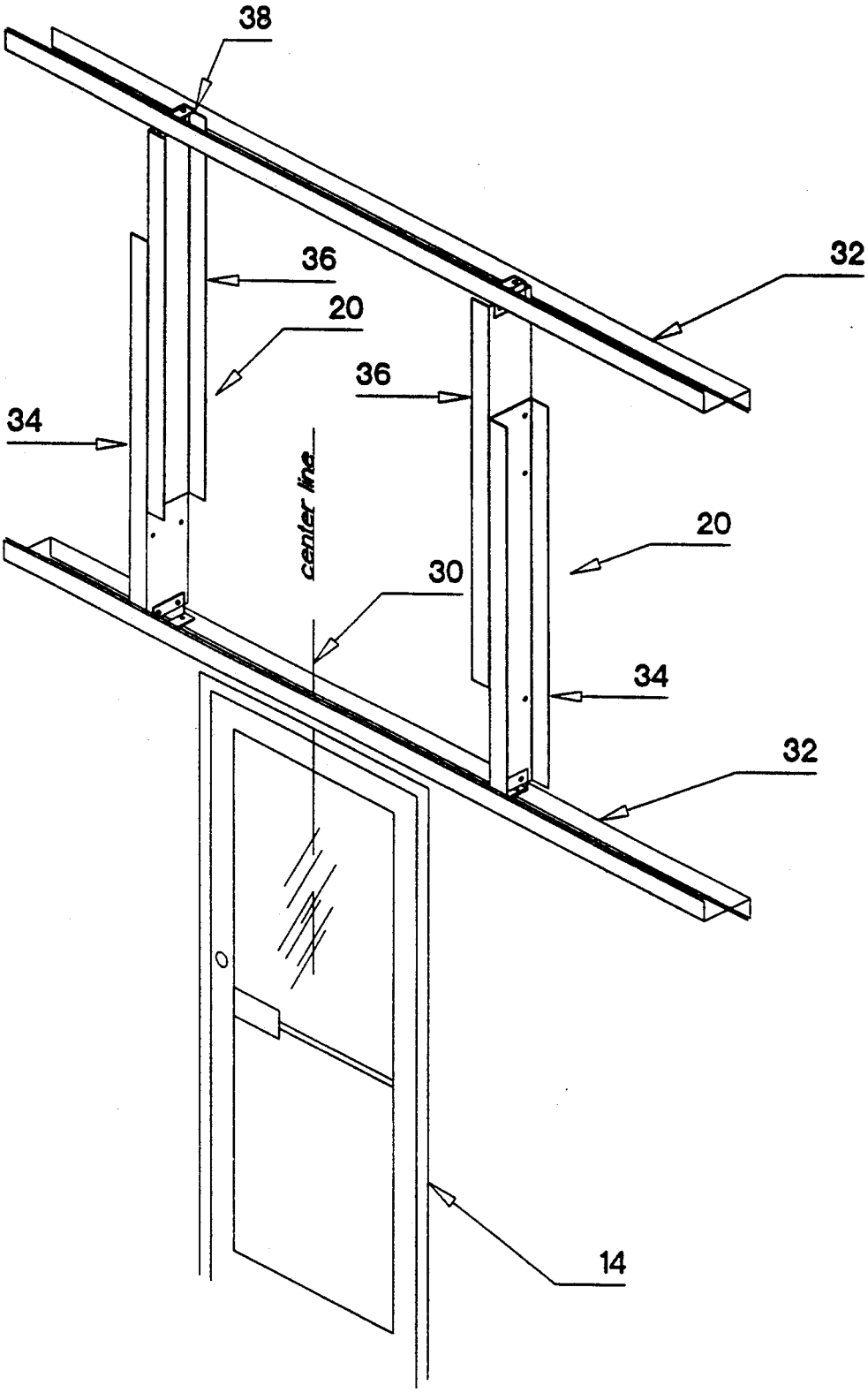
FIG. 3 is a view of the channel assembly shown mounted between the girts above the door.

The canopy is assembled by initially locating the center point 30 above the door 14, FIG. 3. The support channel assemblies 20 are mounted between the girts 32 in the wall at equal distances from the center line 30. Each of the channel assemblies 20 includes a bottom channel 34, a top channel 36, and a pair of clips 38. The clips 38 are initially secured to the bottom channel 34 and top channel 36 by any appropriate means such as screws or bolts (not shown). The distance between the girts is measured and the top channel 36 secured to the bottom channel 34 with the clips 38 located a distance apart equal to the distance between the girts. The channel assemblies are then mounted, as shown in FIG. 3, between the girts 32 and secured thereto by any appropriate means such as screws or bolts (not shown).

Figure 4:
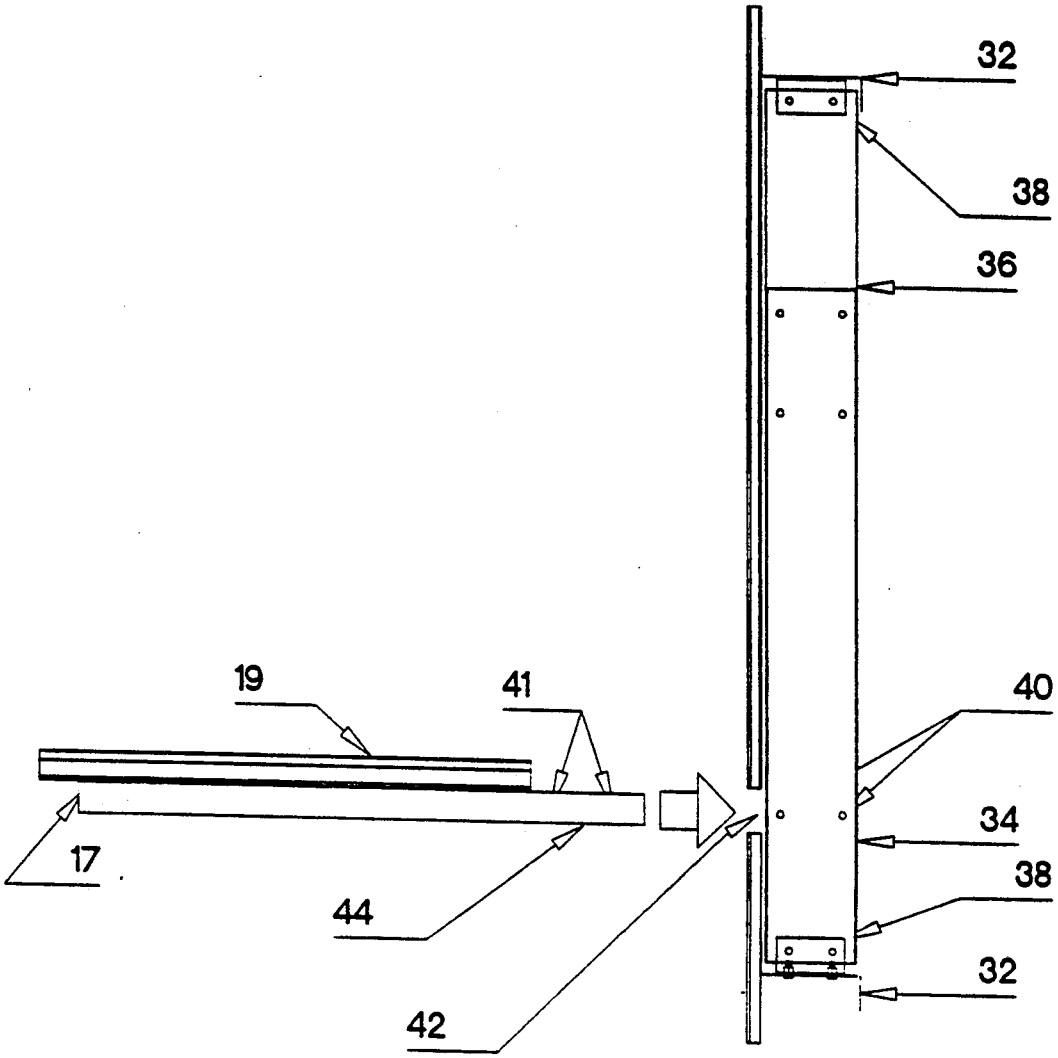
FIG. 4 is a detail view showing the mounting of the frame assembly on the vertical channel assembly.

It should be noted in FIG. 4 that the bottom channel members 34 are provided with mounting holes 40 which are located at equal distances from the bottom girt 32. An opening 42 is cut in the wall sheet in alignment with holes 40 to allow the angle member 44 on each edge of the frame assembly 16 to be located in alignment with the bolt holes 40. The frame assembly 16 generally includes a pair of cross members 17 which are welded to the angle members 44. A number of purlins 19 are secured to the top of the cross members 17 in a parallel spaced relation. The frame assembly 16 is temporarily attached to the channel members 34 by loosely tightening bolts in holes 41 in the ends of angle member 44 and holes 40 in member 34.

A line is drawn on the wall panel flush with the top edge of the frame support assembly 16. The frame support assembly is then removed from the wall and a slot 46 is cut in the wall panels above the line. The frame assembly 16 is repositioned in the alignment with the holes 40 and the angle members secured to the channel members 34.

The roof-trim assembly 18 includes a canopy panel 60 having an eave trim 52 on each side and an eave trim 62 across the front of the panel. The assembly 18 is mounted on the frame assembly 16 by sliding the eave trim 52 onto the angle members 44 on each side of the frame assembly. The roof-trim assembly is secured to the purlins on the frame assembly by washered screws (not shown) located at 6 inch intervals along the purlins.

The step flash 22 is positioned on the inside of the wall panel and projects through the slot 46 over the top of the roof-trim assembly 18. The flash 22 is sealed to the top of the roof-trim assembly 18 by placing a strip of roof tape 53 under the lower leg 21 of step flash 22. The step flash is attached to the canopy panel with washered screws 55 on 6 inch centers. The wall support member 26 is secured to the inside of wall panel 12 by screws 54 to secure the step flash 22 to the wall panel 12.

Figures 5, 7:
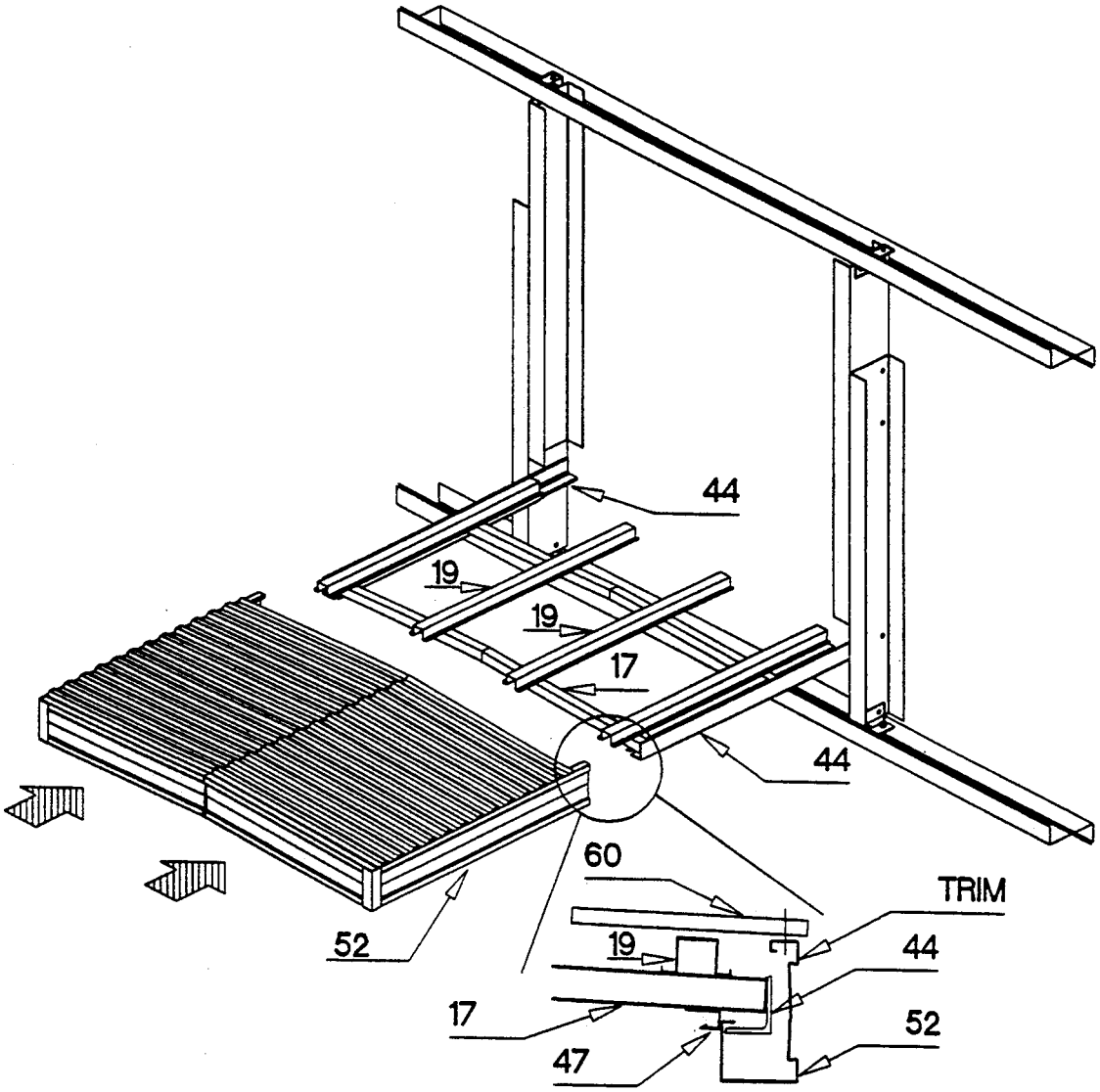
FIG. 5 is a detail view of the assembly of the canopy roof-trim assembly onto the frame assembly.
FIG. 7 is an enlarged view of a portion of the canopy and the frame of FIG. 5.
Figure 6:
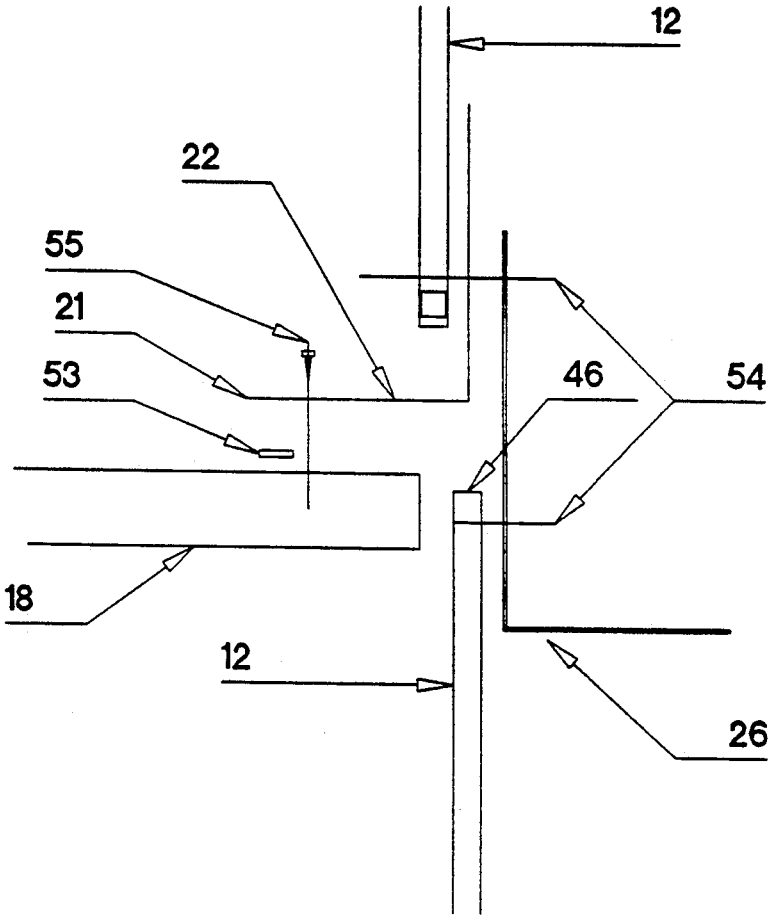
FIG. 6 is a detail view of the relation of the step flash wall support angle assembly and canopy with respect to the wall panel.

The canopy may be enclosed by sliding the soffit sheets 28 onto the members 47 as shown in FIG. 7. The soffit flash 24 is secured to the edge of soffit sheets 28 and abuts the outside surface of the wall panel 12.

Thus, it should be apparent that there has been provided in accordance with the present invention a canopy structure and method of assembly that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A horizontally supported canopy for overhanging a doorway in a wall, an opening in the wall above the doorway and a pair of girts horizontally spaced behind the wall, said canopy comprising:

a pair of vertically adjustable channel assemblies mounted between the girts behind the wall;

a frame assembly having an angle member on each side extending through the opening and mounted on the channel assemblies; and a roof-trim assembly slidably mounted on said frame assembly.

2. The assembly according to claim 1 including a step flash positioned on the inside of the wall and overlying the edge of the roof-trim assembly and a support member on the inside of the wall to secure the step flash to the inside of the wall.

3. The canopy according to claim 2 including a soffit panel mounted in the bottom of the roof-trim assembly to enclose the frame assembly.

4. A method for assembling a canopy on a wall above a doorway having a pair of girts horizontally spaced behind the wall, said method comprising the steps of:

determining the center line of the doorway;

mounting vertically adjustable support channel assemblies on the supporting girts in the wall at equal distances from the center line of the doorway;

positioning a frame assembly over the doorway, securing the frame assembly to the channel assemblies; and sliding a roof-trim assembly onto the frame assembly into abutting relation to the wall.

5. The method according to claim 3 including:

the steps of: drawing a line on the wall along the top of the frame assembly; removing the frame assembly from the wall; cutting a slot in the wall above the frame assembly; replacing the frame assembly on the wall; and resecuring the frame assembly on the girts.

6. The method according to claim 5 including the step of sliding a soffit sheet into the bottom of the roof-trim assembly to enclose the frame assembly.

7. The method of claim 6 including the step of: positioning a step flash on the inside of the wall overlying the roof trim assembly and mounting a wall support member on the inside of the wall to close the slot and secure the step flash to the wall.

* * * * *